US011969042B2

(12) United States Patent
Waldie

(10) Patent No.: US 11,969,042 B2
(45) Date of Patent: Apr. 30, 2024

(54) TAILORED COMPRESSION GARMENTS AND METHODS OF TAILORING COMPRESSION GARMENTS FOR INDIVIDUALS

(71) Applicant: Cape Bionics Pty Ltd, Camberwell (AU)

(72) Inventor: James Waldie, Camberwell (AU)

(73) Assignee: CAPE BIONICS PTY LTD, Camberwell (AU)

( * ) Notice: Subject to any disclaimer, the term of this patent is extended or adjusted under 35 U.S.C. 154(b) by 454 days.

(21) Appl. No.: 17/307,135

(22) PCT Filed: Nov. 4, 2019

(86) PCT No.: PCT/AU2019/051213
§ 371 (c)(1),
(2) Date: May 4, 2021

(87) PCT Pub. No.: WO2020/093090
PCT Pub. Date: May 14, 2020

(65) Prior Publication Data

US 2022/0338586 A1 Oct. 27, 2022

(30) Foreign Application Priority Data

Nov. 5, 2018 (AU) ..... 2018904210

(51) Int. Cl.
*A41H 3/04* (2006.01)
*A41H 3/00* (2006.01)

(52) U.S. Cl.
CPC ..... *A41H 3/04* (2013.01); *A41H 3/007* (2013.01)

(58) Field of Classification Search
CPC . A41H 3/04; A41H 3/007; A41H 1/02; G06T 7/50; G06Q 30/0621
See application file for complete search history.

(56) References Cited

U.S. PATENT DOCUMENTS 4,502,301 A * 3/1985 Swallow ..... A61F 13/08 66/178 A
7,617,016 B2 * 11/2009 Wannier ..... A41H 3/007 705/26.1

(Continued)

FOREIGN PATENT DOCUMENTS

CN 104813340 A * 7/2015 ..... A61B 5/1079
WO WO-2019189846 A1 * 10/2019 ..... A41H 1/02

OTHER PUBLICATIONS

Salleh, M. N. et al., 'Development of a Flexible Customized Compression Garment Design System', The 2012 International Conference on Advanced Mechatronic Systems, pp. 175-179, 2012.

(Continued)

*Primary Examiner* — George B Bennett
(74) *Attorney, Agent, or Firm* — SLEMAN & LUND LLP

(57) ABSTRACT

Embodiments relate to methods for generating at least one custom pattern for use in garment construction, the method comprising receiving scan data relating to a three dimensional scanned body; receiving input regarding a garment use case; selecting at least one compression value based at least in part on the garment use case; calculating at least one negative ease dimension based on the at least one compression value; and modifying predetermined garment pattern dimensions based on the at least one negative ease dimension to generate the at least one custom pattern.

20 Claims, 7 Drawing Sheets

(56) References Cited

U.S. PATENT DOCUMENTS

| | | | | |
|---|---|---|---|---|
| 8,548,622 | B2 * | 10/2013 | Berns | A41D 13/0015 700/130 |
| 9,681,694 | B2 * | 6/2017 | Ng | D04B 37/00 |
| 9,980,527 | B2 * | 5/2018 | Ferrara | A41H 3/007 |
| 10,045,581 | B2 * | 8/2018 | Weiler | G06T 7/60 |
| 10,251,438 | B2 * | 4/2019 | Weiler | A41H 3/007 |
| 10,351,982 | B2 * | 7/2019 | deGuzman | G06Q 30/0621 |
| 11,064,750 | B2 * | 7/2021 | Bajaj | G05B 19/4097 |
| 11,439,194 | B2 * | 9/2022 | Istook | G06V 10/754 |
| 2005/0049741 | A1 | 3/2005 | Dias et al. | |
| 2017/0351246 | A1 | 12/2017 | Colaianni et al. | |
| 2018/0042322 | A1 | 2/2018 | Weiler et al. | |
| 2018/0263324 | A1 * | 9/2018 | Anderson | A41H 3/007 |
| 2019/0008226 | A1 * | 1/2019 | Krivonosova | A41H 3/04 |

OTHER PUBLICATIONS

Xiong, Y. et al., 'Compression Garments for Medical Therapy and Sports', Polymers, vol. 10, No. 6, 2018.

* cited by examiner

TAILORED COMPRESSION GARMENTS AND METHODS OF TAILORING COMPRESSION GARMENTS FOR INDIVIDUALS

CROSS-REFERENCE TO RELATED APPLICATIONS

This application is a continuation of International Application No. PCT/AU2019/051213, filed Nov. 4, 2019, and claims priority to Australian Application No. 2018904210, filed Nov. 5, 2018, the contents of both are incorporated by reference as if fully set forth herein.

TECHNICAL FIELD

Described embodiments generally relate to systems and methods for generating patterns for garment construction. In particular, described embodiments are directed to systems and methods for automatically generating custom garment patterns having negative ease.

BACKGROUND

Form-fitting garments, including compression garments, are worn for a number of purposes. For example, compression garments can provide a physiological benefit in the form of compression recovery wear for athletes, to enhance performance, reduce fatigue and improve exercise, injury recovery and rehabilitation. Compression garments have also been used to treat medical conditions such as lymphatic disorders, circulatory insufficiency and burns or post-operative dermal scarring. Compression garments are also worn to reduce swelling and deep vein thrombosis risk during travel demands.

The athleisure garment industry has also made form fitting garments popular to wear fashion and comfort. In sport, form fitting garments can also function as streamlined, functional uniforms for disciplines such as cycling or swimming apparel.

Form-fitting garments and compression garments typically have a negative ease fit, requiring the fabrics to stretch over the body to be form-fitting and apply compression to the skin. Garments are generally mass produced on standard sizes, with customers being able to select an appropriate size to wear based on a sizing chart.

It is desired to address or ameliorate one or more shortcomings or disadvantages associated with prior systems for generating garment patterns, or to provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

Some embodiments relate to a method for generating at least one custom pattern for use in garment construction, the method comprising:

receiving scan data relating to a three dimensional scanned body;

receiving input regarding a garment use case;

selecting at least one compression value based at least in part on the garment use case;

calculating at least one negative ease dimension based on the at least one compression value; and modifying predetermined garment pattern dimensions based on the at least one negative ease dimension to generate the at least one custom pattern.

Some embodiments further comprise deriving at least one radius value for the scanned body, wherein the compression values are further based on the at least one radius value.

Some embodiments further comprise processing the scan data to remove at least one of a background element, an artefact, and noise. Some embodiments further comprise processing the scan data to smooth the surface of the scan data and fill any holes in the scan data.

Some embodiments further comprise processing the scan data to simplify the scanned data by removing redundant data points. Some embodiments further comprise processing the scan data to align the scan data within a single frame.

Some embodiments further comprise processing the scan data to determine a height of the scanned body. Some embodiments further comprise deconstructing the scan data into a plurality of three-dimensional slices. Some embodiments comprise deconstructing the scan data into a plurality of two-dimensional planes.

Some embodiments further comprise identifying at least one landmark in the scan data. According to some embodiments, the at least one landmark comprises at least one of an ankle, knee, crotch, hip, waist, armpit, wrist, elbow, shoulder or neck.

Some embodiments further comprise processing the scan data to identify at least one segment of the scan data based on the identified landmark. According to some embodiments, the at least one segment comprises at least one of a lower leg, upper leg, torso, or arm.

Some embodiments further comprise determining the lateral dimensions of the pattern based on the scan data and the garment type. Some embodiments further comprise determining the longitudinal dimensions of the pattern based on the scan data and the garment type.

Some embodiments further comprise sending the at least one custom pattern piece data to at least one of a printer cutter, or knitting machine.

Some embodiments further comprise receiving input data regarding a garment type.

Some embodiments further comprise retrieving stored data regarding material properties for a material to be used for the garment.

Some embodiments further comprise generating at least one pattern piece identification tag associated with the at least one custom pattern.

Some embodiments relate to a pattern generation device comprising:

at least one processor; and memory accessible to the processor, the memory storing program code which, when executed by the processor, causes the processor to perform the method of some other embodiments.

Some embodiments relate to a system comprising the pattern generation device of some other embodiments, and a printer configured to receive the at least one custom pattern from the pattern generation device and to print the at least one custom pattern onto a piece of material.

Some embodiments relate to a system comprising the pattern generation device of some other embodiments, and a cutter configured to receive the at least one custom pattern from the pattern generation device and to cut the at least one custom pattern from a piece of material.

Some embodiments relate to a system comprising the pattern generation device of some other embodiments, and a knitting machine configured to receive the at least one custom pattern from the pattern generation device and to knit the at least one custom pattern from at least one piece of yarn.

Some embodiments further comprise a scanning device configured to scan the body and communicate the scan data to the pattern generation device.

BRIEF DESCRIPTION OF DRAWINGS

Embodiments are described in further detail below, by way of example and with reference to the accompanying drawings, in which.

DETAILED DESCRIPTION

Figure 1:
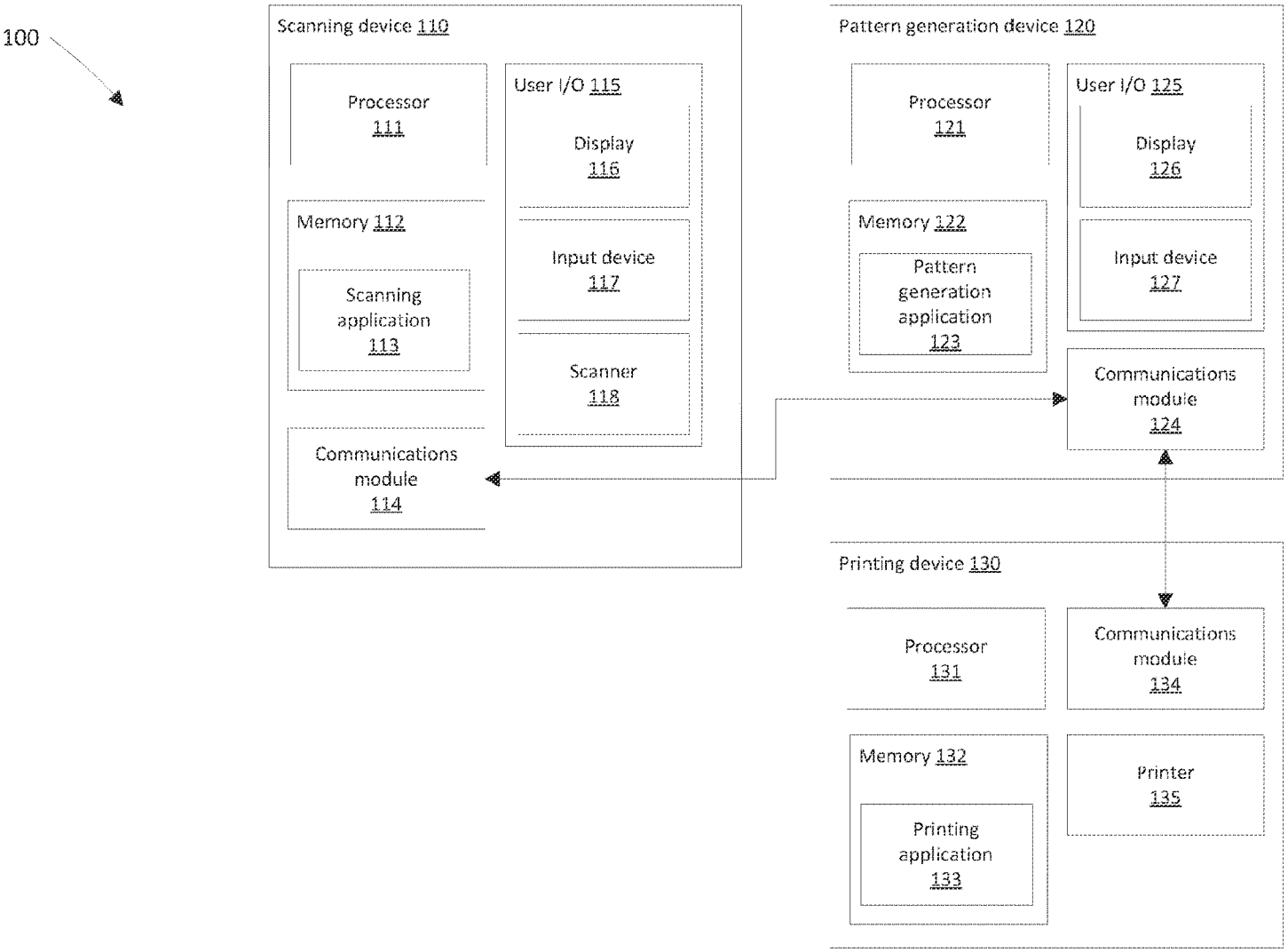
FIG. 1 is a block diagram showing a system for generating garment patterns.

Described embodiments generally relate to systems and methods for generating patterns for garment construction. In particular, described embodiments are directed to systems and methods for automatically generating custom garment patterns having negative ease.

In this document, the term "pattern" may refer to a flat pattern to be used as a template for cutting and assembling garments from a woven or knit textile. The term "pattern" may also be used to describe a garment design, or a set of parameters or instructions readable and executable by a machine to create a garment, whether by knitting, sewing, weaving, or using other garment construction techniques. For example, the term "pattern" may refer to a set of parameters or instructions executable by a circular knit-machine to produce a knit garment.

Applying compression via a compression garment can aid venous return and the drainage of waste products such as lactic acid. The lymphatic system may also be augmented, reducing swelling and oedema in muscles. The nerve cells may be triggered, causing in an increase in proprioceptive feedback and coordinative function. A mechanical support benefit may also be seen, as a reduction in muscle oscillation leads to a reduction in muscle fibre recruitment, energy cost and fatigue, with an increase in movement economy. In some cases, this is done via a graduated compression regime on the lower limbs, with the highest pressure at the lower extremity. The external pressure created by such a regime may also reduce the intramuscular space available for swelling and promote stable alignment of muscle fibres, reducing the inflammatory response and muscle soreness.

The ideal compression regime and fabric to use for a garment will depend on several factors, such as the purpose for which the compression is being used, and the size and shape of the person who will be wearing the garment. The compression regime and fabric to use for a garment to enhance venous return and aid performance for an athlete when running and perspiring, for instance, are different to those required for a garment to remove waste products when sitting in a relaxed recovery state. However, known methods and systems for manufacturing compression garments and for generating compression garment patterns generally use standard garment sizes and design garments to be simply tight on the body of the user, and are not specific in the compression regime or purpose.

Further, manufacturers may recommend a garment size according to the height and mass of an individual, but there is a significant range of limb sizes within each standard size which will affect the fit and compression regime of the garment on the libs of each user. This results in the pressure being produced by mass manufactured compression garments showing large variation within each standard size, even when fitted properly. This causes some individuals to receive insufficient compression to be of benefit, and others to receive excessive compression. In these types of garments, graduated compression regimes have been commonly measured in the opposite direction to that required to enhance venous return. This variation of compression and physiological impact is likely to explain why many studies show mixed results from compression garments, particularly as most garment manufacturers do not measure or verify compression as part of the protocol. Ideally, garments having different compression profiles should be worn depending on whether a user desires to enhance performance, optimise recovery, reduce fatigue, optimise rehabilitation or minimise travel impact. Furthermore, as the user's body shape changes, and materials of the compression garment degrade with use and laundering, new compression garments should be issued to ensure effective compression is maintained.

In some cases, low levels of compression may also be desired by athletes, to be worn as form-fitting apparel to minimise aerodynamic or hydrodynamic drag, discomfort, or inhibition from ill-fitting or loose clothing. The variation in fit from standard sizes can be particularly significant in elite athletes who tend to have more extreme body shape morphologies. Many athletes mix and match compression garments, sometimes going against manufacturer sizing advice, in an attempt to find a garment of sufficient length and compression. Elite swimmers, for instance, have a rule of thumb to use two sizes under the recommended size stated by the manufacturer of the garment. Many sports compression garments are also worn as fashion items beyond the sports arena, with low uniform pressure and soft fabrics providing optimum comfort.

For at least the above reasons, there is a need of a system which can quickly produce high quality, accurate compression garments of custom size and custom compression.

FIG. 1 is a block diagram of a system 100 for generating and, optionally, printing pattern pieces for custom size and custom compression garments. System 100 enables the commercial production of custom compression garments which can impose accurate compression regimes on individuals to improve on or more of performance, recovery, rehabilitation, comfort, aesthetics, DVT/swelling resistance in travel and injury treatments. System 100 can generate and/or import 3D models and garment requirements, and outputs patterns for manufacture, allowing for production of compression garments of bespoke size and compression.

System 100 comprises a scanning device 110, configured to scan the body of an individual for the purposes of allowing a custom compression garment pattern to be produced for the individual. Scanning device 110 communicates scanned data to a pattern generation device 120, configured to analyse the data and produce a garment pattern for production. Where the pattern is a flat pattern for printing, pattern generation device 120 may further be in communication with a printing device 130, configured to print the generated pattern. According to some embodiments, printing device 130 may print the generated pattern onto material, allowing the pattern pieces to be manually cut and sewn to make the garment. According to some alternative embodiments, printing device 130 comprises a laser or fabric cutter that automatically cuts the pattern pieces from the material.

According to some further alternative embodiments, printing device 130 may be replaced by a knitting machine configured to read the pattern to knit a garment. For example, the knitting machine may be a Merz CC4 circular-knit machine, and the generated pattern may be a set of instructions executable by the machine, or a file containing parameters for the garment to be knit. For example, the file may contain parameters such as the height and associated circumference measurements, total length, cuff parameters, name, left/right, and compression levels of the garment to be knit. The machine may take the pattern parameters, convert them into a production algorithm, and produce the garment by varying the diameter or graduation and the yarn tension as the garment is knit in a continuous spiral manner to control compression.

Printer 130 may further be configured to add labels to each pattern piece. Labels may be added to each pattern piece in the form of extra material added to the side of the pattern as text, and removed during assembly of the garment, as described below in further detail with respect to label creation module 342 of FIG. 3.

Scanning device 110 comprises a processor 111 and a memory 112 storing instructions executable by processor 111. Processor 111 may comprise one or more data processors for executing instructions, and may include one or more of a microprocessor, a microcontroller-based platform, a suitable integrated circuit, an application-specific integrated circuit (ASIC), or an arithmetic logic unit (ALU) for mathematical and/or logical execution of instructions, such operations performed on data stored in any internal registers. Processor 111 may be configured to access memory 112, and to execute instructions stored in memory 112. Memory 112 may include one or more memory storage locations, which may be in the form of ROM, RAM, flash, or other memory types. Memory 112 stores a scanning application 113 executable by processor 111, which is described in further detail below with reference to FIGS. 2 and 4. Memory 112 may further store data accessible to be read and written to by processor 111. As scanning application 113 is executed by processor 111, processor 111 may write to and read from memory 112.

Scanning device 110 further comprises user inputs/outputs 115, to allow a user to communicate with scanning device 110. User inputs/outputs 115 may comprise a display 116 for presenting information to a user, at least one input device 117 for receiving information from the user, and a scanner 118. According to some embodiments, display 116 and input device 117 may be embodied in a touchscreen display capable of presenting information and receiving user input. In some embodiments, display 116 may comprise one or more LCD, LED, plasma, cathode-ray or other displays. Input device 117 may comprise one or more buttons, switches, keyboards, digital mice, joysticks, microphones, or other input devices.

Scanner 118 may be configured to scan the body of a user. According to some embodiments, scanner 118 may be located remote to scanning device 110, and be communicably coupled via wireless or wired communication with scanning device 110. According to some embodiments, scanner 118 may comprise a portable computing device having at least one camera or depth sensor, such as an Occipital Structure Sensor, running an application for generating a three dimensional body scan, such as 3DF Zephyr, Netello, 3DFITME or Tec.fit, for example. For example, scanner 118 may be a smart phone or tablet device. According to some embodiments, scanner 118 may comprise one or more laser scanners or cameras. In some embodiments, scanner 118 may be a portable hand-held scanning system, such as Artec EVA. In some embodiments, scanner 118 may be a scanning booth, and may be available within a gym or retail outlet, such as the Vitronic scanning booth, Fit3D or Mport. Scanner 118 may be a home scanning systems such as a Body Labs system.

Scanning device 110 further comprises a communications module 114, configured to facilitate communication between scanning device 110 and external devices such as pattern generation device 120. Communications module 114 may be configured to communicate via a wireless or wired communication protocol, such as USB, Wi-Fi, Bluetooth, or Ethernet, for example.

Pattern generation device 120 comprises a processor 121 and a memory 122 storing instructions executable by processor 121. Processor 121 may comprise one or more data processors for executing instructions, and may include one or more of a microprocessor, a microcontroller-based platform, a suitable integrated circuit, an application-specific integrated circuit (ASIC), or an arithmetic logic unit (ALU) for mathematical and/or logical execution of instructions, such operations performed on data stored in any internal registers. Processor 121 may be configured to access memory 122, and to execute instructions stored in memory 122. Memory 122 may include one or more memory storage locations, which may be in the form of ROM, RAM, flash, or other memory types. Memory 122 stores a pattern generation application 123 executable by processor 121, which is described in further detail below with reference to FIGS. 2, 3 and 5. Memory 122 may further store data accessible to be read and written to by processor 121. As pattern generation application 123 is executed by processor 121, processor 121 may write to and read from memory 122.

Pattern generation device 120 further comprises user inputs/outputs 125, to allow a user to communicate with pattern generation device 120. User inputs/outputs 125 may comprise a display 126 for presenting information to a user, and at least one input device 127 for receiving information from the user. According to some embodiments, display 126 and input device 127 may be embodied in a touchscreen display capable of presenting information and receiving user input. In some embodiments, display 126 may comprise one or more LCD, LED, plasma, cathode-ray or other displays. Input device 127 may comprise one or more buttons, switches, keyboards, digital mice, joysticks, microphones, or other input devices.

Pattern generation device 120 further comprises a communications module 124, configured to facilitate communication between pattern generation device 120 and external devices such as scanning device 110 and printing device 130. Communications module 124 may be configured to communicate via a wireless or wired communication protocol, such as USB, Wi-Fi, Bluetooth, or Ethernet, for example.

Printing device 130 comprises a processor 131 and a memory 132 storing instructions executable by processor 131. Processor 131 may comprise one or more data processors for executing instructions, and may include one or more of a microprocessor, a microcontroller-based platform, a suitable integrated circuit, an application-specific integrated circuit (ASIC), or an arithmetic logic unit (ALU) for mathematical and/or logical execution of instructions, such operations performed on data stored in any internal registers. Processor 131 may be configured to access memory 132, and to execute instructions stored in memory 132. Memory 132 may include one or more memory storage locations, which may be in the form of ROM, RAM, flash, or other memory types. Memory 132 stores a printing application 133 executable by processor 131, which is described in further detail below with reference to FIGS. 2 and 6. Memory 132 may further store data accessible to be read and written to by processor 131. As pattern generation application 133 is executed by processor 131, processor 131 may write to and read from memory 132.

Printing device 130 further comprises a communications module 134, configured to facilitate communication between printing device 130 and external devices such as pattern generation, device 120. Communications module 134 may be configured to communicate via a wireless or wired communication protocol, such as USB, Wi-Fi, Bluetooth, or Ethernet, for example.

Printing device 130 further comprises a printer 135, configured to print generated patterns. Printer 135 may be configured to print patterns onto paper or another medium, to be cut out and used as patterns for cutting fabric for garments. In some embodiments, printer 135 may be configured to print directly onto fabric for creating garments. In some embodiments, printer 135 may comprise a cutter, configured to cut the generated patterns from fabric. In some embodiments, printer 135 may be configured to print labels onto cut patterns, to allow for identification of the pattern pieces.

While FIG. 1 illustrates scanning device 110, pattern generation device 120 and printing device 130 as separate devices, one or more of scanning device 110, pattern generation device 120 and printing device 130 may be combined into a single device in some embodiments. In some embodiments, one or more of scanning device 110, pattern generation device 120 and printing device 130 may comprise a smart phone, laptop, tablet, PC, server, server system, or cloud based computing system.

Figure 2:
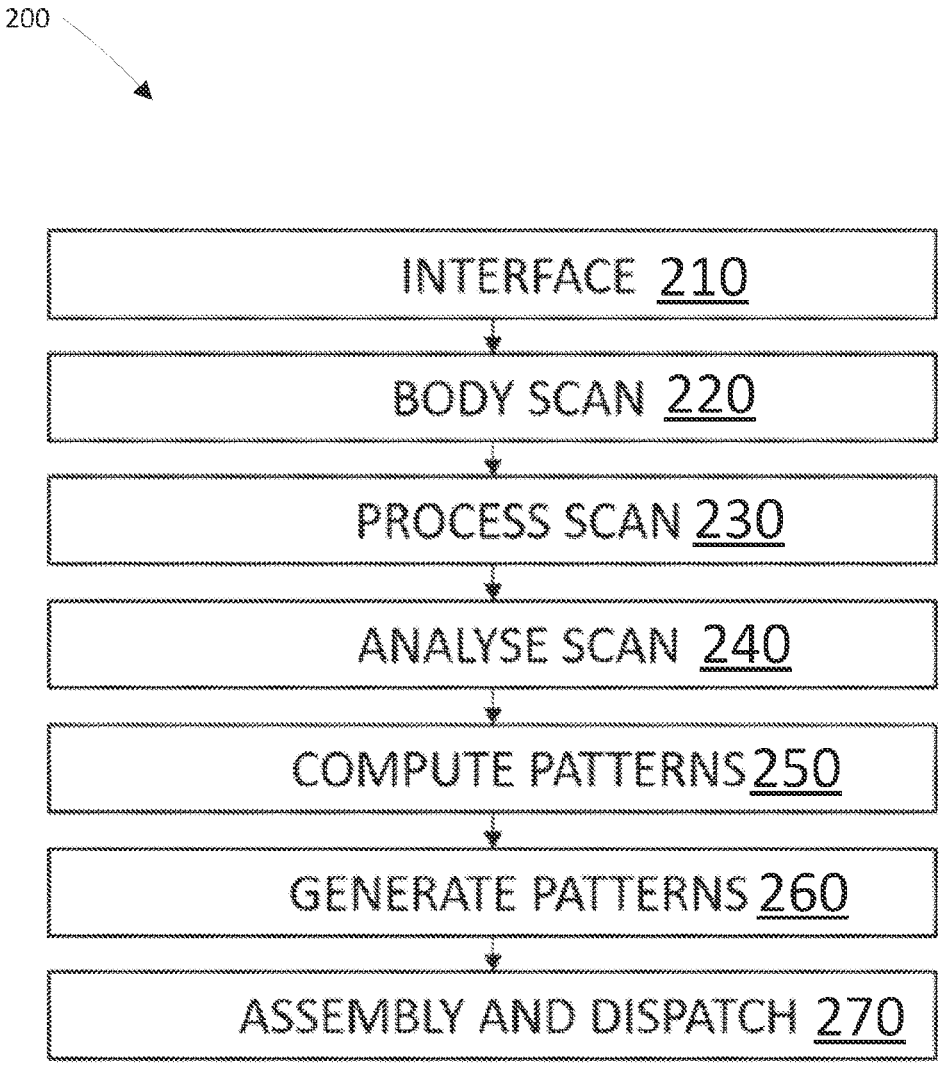
FIG. 2 is a flowchart illustrating a method for generating garment patterns using the system of FIG. 1.

FIG. 2 shows a flowchart illustrating a method 200 for using system 100 to create a custom compression garment.

At step 210, processor 111 of scanning device 110 executing scanning application 113 causes an interface to be presented to a user via display 116. An example interface is described in further detail below with reference to FIG. 4. The interface allows a user to choose a use case for a compression garment via interaction with at least one input device 117. In some embodiments, scanning device 110 may be configured to automatically select an optimum compression regime according to the chosen use case of the garment selected by the user via input device 117. In some embodiments, the chosen use case is communicated to pattern generation device 120 via communications module 114, and pattern generation device 120 may be configured to automatically select an optimum compression regime according to the chosen use case of the garment.

At step 220, a scan of the individual for whom the garment is being manufactured is carried out by scanner 118. According to some embodiments, the scan may be a 3D scan, and scanner 118 may be at least one of a scanning booth, an on-site hand-held 3D scanner, or a camera configured to capture photos and/or videos.

The scanned individual may be instructed to stand freely with legs apart and arms out in a "T" pose. Alternatively, the pose can be modified to best reflect a dominant or crucial position for the individual. For example, a cyclist may be scanned on a bike or in a riding pose. The individual may be asked to wear the normal underwear that will be worn under the compression garment being generated. Alternatively, the subject can be fitted with a scan suit to enhance scanning resolution or frame alignment with dedicated reference points. A scan suit may also be used to remove other influences that can reduce accuracy, such as excessive body hair. The output of the scan may be a scale cloud point file, which may include some noise and/or surrounding artefacts due to the scanning process. Pattern generation application 123 may be configured to process and mesh the point cloud data to appropriate accuracy as a 3D surface model, as described in further detail with reference to FIG. 3, below.

The scan data is captured by scanning device 110 and communicated to pattern generation device 120 via communications module 114. According to some embodiments, the scanning step may optionally be replaced by asking the user to input manual measurements of the individual via input device 117, which may recorded and sent to pattern generation device 120 for use in a simplified pattern template.

At step 230, having received the scan data and the garment use case, processor 121 of pattern generation device 120 executes pattern generation application 123. As described in further detail below with reference to FIG. 3, pattern generation application 123 is configured to filter, simplify and fuse the scan data received from scanning device 110 to produce a surface model of the individual. According to some embodiments, the model may be a water-tight 3D surface model.

At step 240, processor 121 of pattern generation device 120 executes pattern generation application 123 to perform analysis of the surface model produced at step 230. As described in further detail below with reference to FIG. 3, the surface model is orientated, anthropometric landmarks are detected, and a matrix of measurements is produced. In particular, cross-section perimeters and local radii at regular slices along the vertical axis of the model are determined. Other common body measurements may be determined in some cases necessary.

At step 250, processor 121 of pattern generation device 120 executes pattern generation application 123 to determine the flat pattern dimensions to produce the required negative fit in the compression garment, based on material properties of the fabric to be used for the compression garment, and Laplace equations. Calculations are performed with respect to each vertical slice point as determined at step 240, with longitudinal tension varying the height of each slice in the pattern as necessary.

At step 260, processor 121 of pattern generation device 120 executes pattern generation application 123 to generate flat patterns from parametric templates. Each flat pattern may be generated to include a seaming allowance and a unique garment tag. Patterns may be generated in a nested format for batch cutting to minimise fabric wastage and to increase processing efficiency.

At step 270, the flat patterns generated at step 260 are sent to printing device 130 via communications module 124 for printing and/or cutting. Once cut, the patterns are grouped via their unique garment tags. The tags are then removed, and the garment patterns sewn, inspected and dispatched as custom compression garments.

Figure 7:
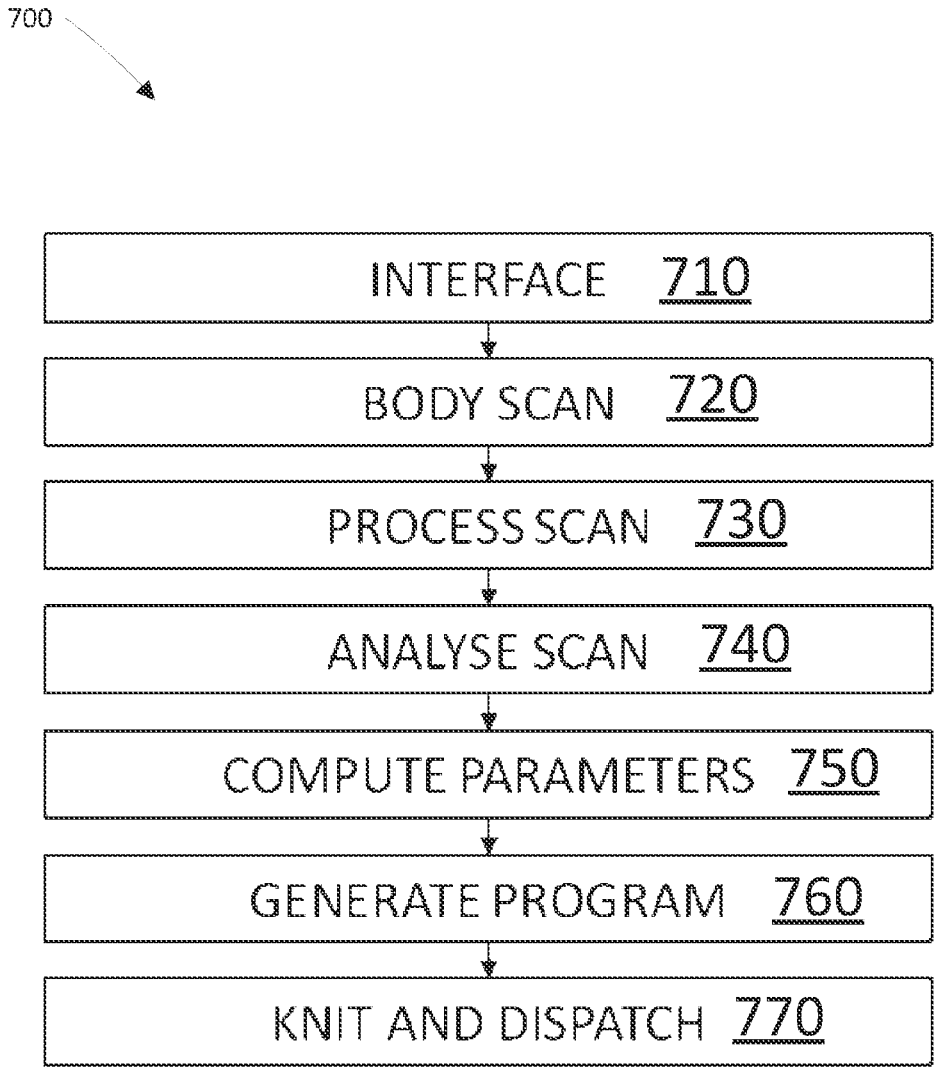
FIG. 7 is a flowchart illustrating an alternative method for generating garment patterns using the system of FIG. 1.

As described above, in some embodiments the pattern may comprise a set of parameters or instructions readable and executable by a knitting machine to produce a custom knit garment. FIG. 7 shows an alternative flowchart illustrating a method 700 for using system 100 to create a custom knit compression garment.

Method 700 comprises steps 710, 720, 730 and 740, being identical to the steps of method 200. Specifically, at step 710, processor 111 of scanning device 110 executing scanning application 113 causes an interface to be presented to a user via display 116. At step 720, a scan of the individual for whom the garment is being manufactured is carried out by scanner 118. At step 730, having received the scan data and the garment use case, processor 121 of pattern generation device 120 executes pattern generation application 123. At step 740, processor 121 of pattern generation device 120 executes pattern generation application 123 to perform analysis of the surface model produced at step 730.

After performing step 740, processor 121 of pattern generation device 120 performs step 750, executing pattern generation application 123 to generate the parameters to be used by an automated knitting machine configured to produce the required negative fit in the compression garment. The parameters are generated based on material properties of the yarn to be used for the compression garment, the desired compression level, and the variables of the machine. This machine may be a circular knit machine, such as the Merz CC4, which knits the garment in a continuous seamless spiral. Compression can be varied continuously through the knitting process by changing the tube diameter or graduation of the garment, and by adjusting the yarn feed tension. Compression may be adjusted with respect to each vertical slice point as determined at step 740.

According to some embodiments, the pattern generated at step 750 may be in the form of a set of replacement values for varying the basic machine program of the knitting machine, such as the step value, ramp value, stitch value and sinker value for the default measurement locations. In another embodiment, individual programs can be formed for the machine. Parameters for individual programs may include a custom number of measurement points, the subject name to be knitted, cuff double welt parameters, colours/patterns, and reciprocated heel or toe data, for example.

At step 760, processor 121 of pattern generation device 120 executes pattern generation application 123 to generate a set of executable instructions based on the parameters generated at step 750. The executable instructions may be exported into a polling directory of the knitting machine via communications module 124, which queues the garment programs for production.

At step 770, the instructions generated at step 760 are sent to the knitting machine via communications module 124 for execution. The knitting machine executes the instructions to knit a garment according to the specified parameters. Once cut, the patterns are grouped via their unique garment tags. The tags are then removed, and the garment patterns sewn, inspected and dispatched as custom compression garments. Once knitted, the garment may be finished, inspected and dispatched.

Figure 3:
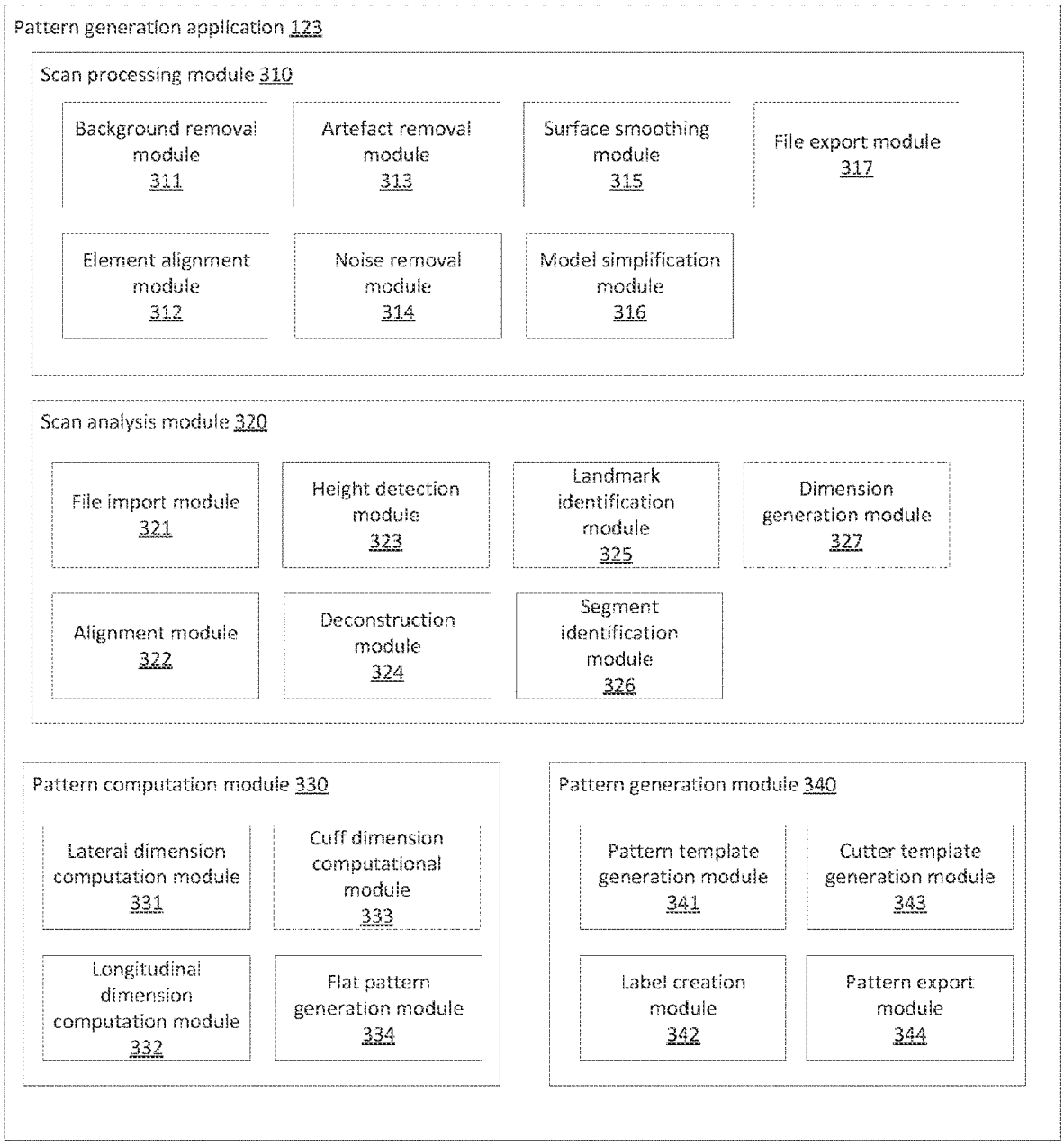
FIG. 3 is a block diagram showing the pattern generation application of FIG. 1 in further detail.

The system of FIG. 1 and the methods of FIGS. 2 and 3 may be used to produce patterns of any form, which may include calf sleeves, long socks, arm sleeves, forearm sleeves, shoulder support sleeves, knee support sleeves, leggings, leggings with socks, leggings with cut-out socks, shorts, sleeveless coveralls, bibs, jerseys with long or short sleeves, or full suits.

System 100 may be used by a customer in a retail setting, where the customer is scanned in a retail scanning booth for a pair of custom leggings. In another case, an athlete may be able to scan themselves using on their mobile phone acting as scanning device 110, to order custom running shorts and travel socks. In another use, an athlete with an injured hamstring may be scanned by a scanning device 110 located at their physiotherapist, and issued with custom leggings to help improve recovery and reduce the chances of reoccurrence. In another use case, all athletes from a professional team may be scanned by one or more scanning devices 110. After understanding the team requirements for the next quarter, each athlete may subsequently be issued a suite of custom calf sleeves and long tights to deliver optimum compression regimes for performance, recovery, rehabilitation and travel enhancement. After that quarter, the athletes may be scanned again, and a new suite of garments issued. Different compression regimes or materials may also be desired for the next quarter due to changes in weather, the start of competition, or other reasons. In another case, a team of cyclists may be scanned and each issued with custom riding jerseys. In another case, a swimmer may take their own manual measurements and submit them via scanning device 110 for the production of one or more custom training and performance suits.

System 100 may be configured to store data generated or received by system 100 securely and privately, as the data may include personally identifiable information. Such personal data may be stored and communicated in accordance with standards such as the US Health Insurance Portability and Accountability Act of 1996 (HIPAA).

Figure 4:
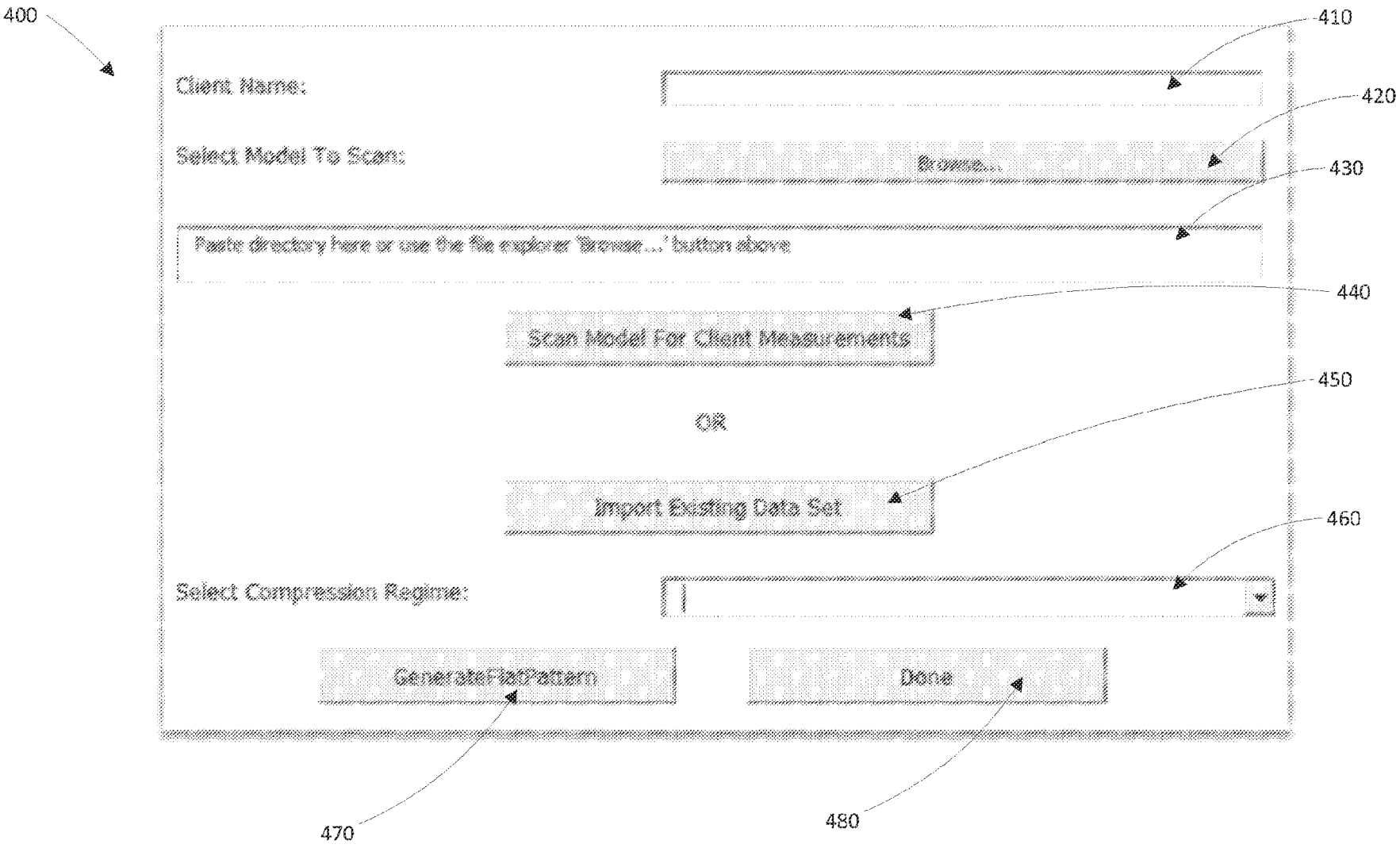
FIG. 4 is an example screenshot displayed by the scanning device of FIG. 1.

FIG. 4 shows an example interface 400 that may be displayed on display 116 of a scanning device 110 executing scanning application 113. Interface 400 may allow users, including brand consultants and consumers, to order custom compression garments. Orders can be created and submitted by customers via scanning device 110, which supplies and queues data such as a Stock Keeping Unit (SKU) or other product and service identification codes used for stores or products, the scan file, and garment type(s). Users may be prompted to enter a client name into text field 410 of interface 400, and to either select a pre-existing scan file or to initiates a scanning process on the device. A pre-existing scan file may be loaded by browsing files stored in memory 112 of scanning device 110 via button 420, or by entering the directory of the file using text box 430. A new scan file can be created by scanning an individual using scanner 118, which may be initiated by selecting button 440. Alternatively, an existing data set may be imported using button 460.

In some embodiments, rather than performing a body scan, manually measured body size data may be submitted. For example, the measurements may be measured using a tailor's tape and recorded. The measurements required for each garment and instructions may be displayed to the customer via display 116. For instance, a calf sleeve may require the user to enter measurements for ankle circumference, max calf circumference with height from ankle, and top circumference with height from ankle. In this case, steps 220 to 240 of method 200 may be skipped.

Regardless of whether a body scan is taken or measurements are submitted, a compression regime may be required to be selected for the desired compression garment. For example, the user may be able to select whether the garment is being used to maximise performance, recovery, rehabilitation, comfort, aesthetics, DVT/swelling resistance in travel, for injury treatments, or other purposes. The compression regime options may be predetermined selectable options stored in memory 112 alongside application 113. According to some embodiments, scanning application 112 determines a default graduated or uniform compression regime that is optimum for the selected purpose. The range of compression selected may be between 5 and 60 mmHg. According to some embodiments, compression values for recovery and injury may be higher than those for other uses. Custom compression regimes can also be defined by a user in place of the default regime. According to some embodiments, each generated and stored compression regime may be labelled by date, from which an expiry date may be calculated to indicate the duration for which the scan data will be valid. After expiry of the date, a new body scan may be required.

Once all the data is entered, the user can select "Done" button 480 to save their compression garment data, or the "GenerateFlatPattern" button 470 to send the data to pattern generation device 120 for pattern generation.

In some embodiments, bulk order interfaces similar to interface 400 may be used by consultants representing professional teams. Interface 400 and scanning application 113 may be part of a larger Point of Sale (POS), Customer Relationship Manager (CRM), or other order fulfilment system. Data can be transmitted to pattern generation device 120 via an encryption protocol for secure exchange of private data.

FIG. 3 is a block diagram showing the modules within pattern generation application 123 in further detail. Pattern generation application may include a number of code modules, including a scan processing module 310, a scan analysis module 320, a pattern computation module 330 and a pattern generation module 340. Each of the modules may contain one or more sub-modules, as described below. According to some embodiments, one or more of the modules or sub-modules may be implemented using an API with external software such as Artec Studio, for example.

Scan processing module 310 may comprise a background removal module 311. Background removal module 311 may be configured to identify and remove background elements of the received scan, such as the floor, chairs, tables or bike frames. Large flat areas may be automatically defined as the floor and removed in software. The z axis may also be trimmed to eliminate irrelevant or unused data. This trimming could be calculated based on known landmarks, or estimated dimensions based on the average subject size and proportions. Other complex elements may need to be manually removed, or may be retained for automated removal by module 320 if using a predefined element shape. For example, a particular bicycle shape may be predefined and stored to allow for removal of a bicycle shape from a scan of a cyclist.

Scan processing module 310 may further comprise an element alignment module 312. Element alignment module 312 may receive the processed scan data from module 311, and align the elements of the scan to a single coordinate system, preparing them for further processing and analysis. The scan data received from module 311 may be comprised of many scans or frames stitched together. Element alignment module 312 may be configured to process and register each scan frame and align each frame to a single global frame.

Scan processing module 310 may further comprise an artefact removal module 313. Artefact removal module 313 may receive the processed scan data from module 312, and identify artefacts or outliers that exist as separate elements to the main body of the scan. These artefacts may then be removed from the scan. This may be done by identifying the largest object in the scan, and defining this as the subject. All other elements may be considered artefacts and deleted.

Scan processing module 310 may further comprise a noise removal module 314. Noise removal module 314 may receive the processed scan data from module 313, and identify and remove noise from the scan. Noise may be identified by searching for outliers in the scanned data. The outlier-removal approach may be based on a statistical algorithm, which may be configured to calculate the mean distance between a surface point and a predetermined number of neighbouring points, as well as the standard deviation of these distances. All points whose mean distances are greater than a value defined by the global distance mean and standard deviation may then be classified as noise and removed from the scene.

Scan processing module 310 may further comprise a surface smoothing module 315. Surface smoothing module 315 may receive the processed scan data from module 314, and fuse and smooth the remaining surface to create a single contiguous surface or "watertight" model. Any edges are identified as the perimeter of one or more holes, and any holes or missing elements in the model are automatically filled by creating new points by interpolation.

Scan processing module 310 may further comprise a model simplification module 316. Model simplification module 316 may receive the processed scan data from module 315, and simplify the processed scan data to create a smaller file with a reduced number of polygons, while still retaining sufficient 3D geometry, to reduce subsequent processing requirements. In particular, model simplification module 316 may be configured to identify any scan points which can be removed without significantly affecting the shape of the model, and remove these points. According to some embodiments, the scan may be simplified to contain no more than 20,000 faces.

Scan processing module 310 may further comprise a file export module 317. File export module 317 may receive the processed scan data from module 316, and export the scan data for sending to printing device 130 or to a knitting machine. According to some embodiments, the scan data may be exported as a stereolithographic (.stl) file. In some embodiments, the scan data may be exported as another file type that formats the scan data as a raw, unstructured triangulated surface identified by the unit normal and vertices (ordered by the right-hand rule) of the triangles using a three-dimensional Cartesian coordinate system that is orientated to the body of the scanned individual. According to some further embodiments, the scan data may be exported as a set of instructions readable and executable by a knitting machine.

The exported file may be imported into the scan analysis module 320 via file import module 321.

Scan analysis module 320 may further comprise an alignment module 322. Alignment module 322 may receive the imported file from file import module 321, and translate the scan model saved in the file from a global registration coordinate system to an XYZ frame, representing the anterior (front), transverse (side) and longitudinal (vertical)

major axes of the scan. An example frame showing the alignment process is described in further detail below with reference to FIG. 5.

Scan analysis module 320 may further comprise a height detection module 323. Height detection module 323 may receive the frame generated by alignment module 322, and determine a height of the scanned subject. If the scan is of the full body of the individual, height is determined as the distance between the base X-Y plane (as described below with reference to FIG. 5) at the sole of the feet and an apex X-Y plane at the top of the head. In some embodiments, height detection module 323 may determine the height to be the largest dimension of the rectilinear space which contains the model element.

The determined height may be approximate depending on the posture of the individual when the scan was performed. For example, where the individual had their legs splayed during scanning, the total body height determined by height detection module 323 may be smaller than the individual's actual height. According to some embodiments, a more accurate system of height detection may be employed, such as by measuring the individual's leg length along the angle of the leg as positioned, and adding this to the height of the torso and head of the individual. In some embodiments, the individual's height may be measured separately and entered into scanning device 110 alongside the scan data.

According to some embodiments, height detection module 323 may be configured to also provide an approximate z-axis range for the position of other landmark areas of the scan, including ankles, knees, crotch, waist, hips, armpits, wrists, elbows, shoulders, necks and other key areas, based on known average body proportions. These ranges may be used by pattern generation application 123 to check location data determined autonomously from the scan, as described below.

Scan analysis module 320 may further comprise a deconstruction module 324. Deconstruction module 324 may receive the frame generated by alignment module 322 and the height and range data generated by height detection module 323, and deconstruct the scanned data in the frame into a series of horizontal (X-Y plane) three dimensional slices at a set spacing up the Z-axis. For example, the first slice may be taken at the base of the model (which may correspond to the location of the soles of the feet of the scanned individual). Each subsequent slice may be taken vertically upward, until the apex of the scanned model is reached. The thickness of the slices may be selected to balance accuracy and processing time. The smaller the spacing of the slices, the more accurate the calculations that are later performed on the model. However, the smaller the spacing of the slices, the larger the increase in processing time. According to some embodiments, the z-spacing of the slice thickness may be around 2 mm.

According to some alternative embodiments, deconstruction module 324 may receive the frame generated by alignment module 322 and the height and range data generated by height detection module 323, and deconstruct the scanned data in the frame into a series of horizontal (X-Y plane) two dimensional planes at a set spacing up the Z-axis. For example, the first plane may be taken at the base of the model (which may correspond to the location of the soles of the feet of the scanned individual). Each subsequent plane may be taken vertically upward, until the apex of the scanned model is reached.

Scan analysis module 320 may further comprise a landmark identification module 325. Landmark identification module 325 may receive the deconstructed frame data generated by deconstruction module 324, and may identify landmarks of the scan. For each slice generated by deconstruction module 324, landmark identification module 325 may determine the number of solid elements in the slice, and the circumference of each slice element. According to some embodiments, local radius values for each slice may also be determined. The identified data may be stored in a matrix in memory 122. If the scan incorporated both arms and/or both legs of the individual, separate data may be derived and stored for the left and right arms and legs.

Once the number of elements and dimensions of elements in each slice are determined, landmark identification module 325 may be configured to use this data to identify landmarks. For example, working up from the base slice, the ankle landmark may be determined to be the z-location at which a slice has the smallest local perimeter within a predetermined ankle range height, where the slices adjacent each have larger perimeters. The base of the knee may be determined to be the z-location at which a slice has the smallest local perimeter within the predetermined range height for the base of the knee, with adjacent slices having larger perimeters. The crotch may be determined to be the z-location where the total perimeters of the individual legs reduce to form a single and larger total perimeter. Landmark identification module 325 may also determine whether this point lies within a predetermined range. Furthermore, as the crotch is the point where the two separate leg slices become one torso slice, this can be checked by confirming the model is contiguous between the centroid of the left and right leg slices. This check can be useful to ensure that thighs or the male genitalia do not conjoin the leg slices into a single connected element lower than the true crotch location. The waist may be determined to be the z-location at which a slice has the smallest local perimeter within a predetermined waist range height, with adjacent slices having larger perimeters. In some embodiments, the waist may also be determined to be the z-location at a set offset from the determined crotch height, based on known or expected proportions of typical persons. The armpit may be determined to be the z-location where 3 separate and spaced slice elements reduce from 3 separate bodies into a single slice, within a predetermined armpit range.

If landmark identification module 325 cannot determine a suitable landmark for one or more regions within the predetermined range, processor 121 executing pattern generation application 123 may prompt an operator of pattern generation device 120 via display 126 to confirm a selection outside the range, or manually select a location for the landmark, using input device 127. In some embodiments, processor 121 executing pattern generation application 123 may determine landmarks based on known or expected proportions of typical persons.

Scan analysis module 320 may further comprise a segment identification module 326. Segment identification module 326 may receive the matrix of landmark data stored in memory 122 by landmark identification module 325, and, based on the z-location attributes of key landmarks and the desired garment, may reduce the data stored to include only the relevant segments for the chosen garment type selected by the user via scanning device 110 at step 210. For example, where the chosen garment is a pair of leggings, only data pertaining to the z-slices between the ankle landmarks and the waist landmark may be retained.

Scan analysis module 320 may optionally also comprise a dimension generation module 327. Dimension generation module 327 may be configured to determine further dimensions of the scan, such as torso girths, rise, collar, bust, inseam, neck line, and other dimensions, based on the stored landmark data. These additional measurements may be required where the garment is a larger garment or covers a complex part of the body, which may be the case for tights, tops and coveralls, for example. This determination may be made by module 327 using an API with external 3D CAD software, such as Solidworks®. All determined measurements may be stored in an array within memory 122, which may be a VBA, VB.NET, Visual C#, Visual C++ 6.0, or Visual C++/CLI array in some embodiments.

Data generated by segment identification module 326 and dimension generation module 327 may then be used by processor 121 executing pattern computation module 330.

Pattern computation module 330 comprises a lateral dimension computation module 331. Lateral computation module 331 may be configured to cause processor 121 to determine the lateral or circumferential width of the pattern or garment to be generated, by reducing the size of the model based on the material properties of the garment to be manufactured and the desired skin pressure or compression factor. The wall tension equation for cylindrical vessels or Laplace pressure equation may be used to determine the tension needed in the material:

$$T=p*r$$

where p is the surface pressure that the material needs to provide, T is the desired circumferential material tension to be provided by the garment and r is the local body radius calculated based on the segments stored by segment generation module 326. The desired circumferential material T is determined based on the selected compression regime, and r is known based on the scan data. Once the surface pressure p is known, the degree to which the material to be used needs to be stretched to provide the desired surface pressure p can be determined from the elastic modulus of the material, which is derived from material testing. The elastic modulus provides a relationship between strain (stretch) and stress (tension) of the material. The pattern or garment is undersized so that when worn, it is stretched the calculated amount which produces the desired tension, and therefore the desired pressure.

Known measurement processes sometimes assume that a limb is essentially circular in cross section, and so determine an average radius for the limb. In some cases, soft padding is used to assist in the rounding of the limb, and to remove any local variance in shape. However, this can be undesirable in the case of a compression garment designed to be worn for sporting activities. To alleviate the issues of local variances in radius of a limb, lateral dimension computation module 331 determines the local radius for each part of the limb based on the scan data, to provide the most accurate input to the Laplace pressure equation described above. The radius used for the equation may be selected according to a selected critical region on the body. For example, the belly of the calf muscle on the shank may be selected for recovery, or the radius may be selected to specifically target an injured ligament. To create an accurate local radius that is not impacted by fine detail in the model, a radius point is selected, then two points generated either side around the perimeter to produce a local arc and radius. According to some embodiments, the two points may be generated either side at between 6 degrees and 20 degrees around the perimeter. According to some alternative embodiments, the radius may be determined based on the average radius of the entire circumference if it were imagined to be a true circular slice.

When donned, compression garments can modify the underlying form of the wearer, compressing the user's body and thereby modifying the local radius. In some embodiments, a compression 'shape rounding' index may be incorporated into the equation outlined above, to produce a more accurate result and so that the system predicts and calculates the garment dimensions based on the final as-worn shape, rather than the naked scanned (or measured) shape of the individual. The shape rounding index may be based on the location, size and pressure towards the average radius value, in some embodiments.

For an accurate result when making a garment from a fabric, pattern generation application 123 may require input of the tension properties in both the warp (longitudinal) and weft (lateral) directions of the material to be used, so that the garment being produced can be accurately undersized to provide the desired compression regime. The elastic modulus, which provides a relationship between strain (stretch) and stress (tension) of the material, may be used in the calculations to determine the required sizing of the pattern pieces or pattern parameters to be produced. The relationship between the strain and the stress may be a linear relationship for some materials, particularly in the lower strain region of the material, or it may be a complex set of equations to describe a non-linear relationship.

The material or materials used for each garment may be chosen in part according to their tensile properties. In some embodiments, it may be desirable to have a flat elastic modulus region in the weft at the as-worn strain, so that the stress, tension and therefore pressure shows minor change with variation in the body size or shape, for instance due to movement or respiration.

The tensile or elastic properties of materials tend to degrade with time, generally showing higher initial degradation in the first few stretch cycles and then remaining fairly constant after that. Permanent stretch can be created with use due to the friction and structural changes in the molecular chains of the elastane fibre during stretching and recovery, and hysteresis in elastane fibres themselves. This relaxation can lead to inferior compression levels and bagging of the material. Robust resistance to relaxation is also a property desired in sports garments to maintain compression. Robust resistance to relaxation may be largely defined by the fibres and weave of the material used, but also the imposed strains. A maximum use strain is often defined to minimize relaxation. According to some embodiments, pattern generation application 123 may be configured to use for pre-aged materials, or to use a degradation factor, so that the compression is accurate when the garment has been worn and matured.

Pattern computation module 330 further comprises a longitudinal dimension computation module 332. Where the garment is being made from a fabric, longitudinal dimension computation module 332 may be configured to cause processor 121 to take into account the longitudinal stretch of the fabric to be used, to determine the longitudinal dimensions of the pattern pieces to be produced. In some embodiments, it may be desirable to use materials having a weaker modulus of elasticity in the longitudinal direction, to allow for the final garment to easily stretch and offer minimum hindrance to movement. If using material with a strong modulus of elasticity in the longitudinal direction, the garment when worn may hinder leg flexion in the knees and hips, for example. For this reason, in some embodiments it may be desirable to use an anisotropic material that has two different moduli of elasticity in the longitudinal and lateral directions. Materials can also be selected that allow compression when a muscle is flexed, but no compression when at rest. It is often desired to incorporate at least a small degree of longitudinal stretch so that the garment has some tension in the warp direction when worn to reduce the possibility of the material bagging. For example, a material having 5% longitudinal stretch may be used. As the longitudinal length of the garment will reduce when it is donned, as it is stretched laterally around the limb, longitudinal dimension computation module 332 may use Poisson's ratio in the calculations to modify the longitudinal length appropriately. Poisson's ratio describes how the dimensions of an object change under load. In particular, if an object is compressed or stretched in one axis, Poisson's ratio describes how the dimensions change in the other axes. Longitudinal dimension computation module 332 may be configured to determine the Poisson's ratio between the lateral stretch of the material to be used and the contraction produced in the longitudinal axis of the material as a basic material property. The ratio may be derived based on data from uniaxial tests. As the lateral stretch at each slice point is known, longitudinal dimension computation module 332 can calculate the material longitudinal contraction. Longitudinal dimension computation module 332 can then determine how much to increase the slice height in the pattern piece or pattern parameters so that it allows for the calculated contraction.

In some embodiments, longitudinal stretch based on a gravity loading regime may also be incorporated to deliberately add resistance. By donning a garment designed with a gravity loading regime, individual wearing the garment may experience a simulated gravitational load, either at 1 G (Earth sea level) or other gravitational levels, such as Lunar (0.16 G) or Mars (0.38 G). In general, the garment may be designed to be shaped and sized to cover at least a torso portion and a leg portion of the individual's body. By placing the suit on the body, the higher modulus of elasticity along the axial direction of the body can impose mechanical loading, while the lower modulus of elasticity around the circumference can secure the garment to the body of the individual in a skin-tight manner while permitting expansion and contraction of the suit that might occur during breathing, muscle flexion, and other movement. For a 1 G loading regime in a zero-gravity environment, the loading designed to be imposed by the garment may increase from the top of the individual's body to the bottom of the individual's body, reaching approximately 1 G of loading at or near the bottom of the body.

Pattern computation module 330 may optionally comprise a cuff dimension computation module 333 in some embodiments. Cuff dimension computation module 333 may be configured to cause processor 121 to perform separate calculation for any elastic cuffs that are to be added to the garment, as the elastic of the elastic cuffs may have different properties than the primary material. The cuff calculations performed by cuff dimension computational module 333 may help to ensure that the resulting garment provides a consistent compression regime across different fabrics and sections of the garment. If any sections of the garment aside from the cuffs are to be made in a different material to the primary material of the garment, cuff dimension computational module 333 may further be configured to perform separate computations for these materials.

Once the latitudinal and longitudinal dimensions for each material to be used are determined by modules 331, 332 and 333, flat pattern generation module 334 may use the actual measurement data and material properties to determine the desired flat pattern dimensions, if a flat pattern is being manufactured. Where the garment is to be knitted, no flat patterns are generated, and instead pattern parameters are used to generate executable instructions for a knitting machine, as described above. The primary calculations used by flat pattern generation module 334 may be based on the Laplace Pressure Equation at each slice point along the vertical axis, with the predetermined desired longitudinal tension varying the height of each slice point as necessary. The surface pressure at each slice location is defined or extrapolated from the selected compression regime and the data generated by lateral dimension computation module 331. When manual measurements are used, calculations are made for each circumference, and the local radius is calculated as the average radius for each circumference, assuming it is circular.

For each slice point, flat pattern generation module 334 may determine the 'as-worn' perimeter of the body part, the critical local radius, the desired compression, the required material tension, the required strain, and new pattern perimeter, as discussed above. The new pattern perimeter determined by flat pattern generation module 334 defines the lateral size of each pattern piece, and is calculated to be appropriately smaller than the determined dimensions of the scanned individual to provide the negative fit and desired compression regime. The longitudinal size of the pattern is also determined at each slice point as a variation on the original slice spacing.

According to some embodiments, pattern generation application 123 may be configured to use the properties of a default material for pattern generation. If a calculated strain value exceeds the acceptable range allocated for the default material, a second material with suitable properties may be automatically chosen by pattern generation application 123. The acceptable strain value range may be determined based on experimental data for each material type. Flat pattern generation module 334 may then autonomously export the calculated pattern compression measurements to a database file located in memory 122, and saved for future reference.

Having calculated the pattern dimensions, processor 121 may be configured to execute pattern generation module 340 to generate the pattern pieces, pattern parameters, or executable pattern instructions. Pattern generation module 340 may be configured to autonomously generate a flat pattern, ready for cutting and assembly, or to generate a set of instructions for execution by a knitting machine. Pattern generation module 340 may be configured to use a 2D CAD package such as AutoCAD or SolidWorks to generate the flat pattern. Parametric pattern templates for each garment type may be stored in memory 122 for retrieval by pattern template generation module 341. These templates may be of a basic shape and configuration for each garment, defined by variable parameters that are populated by the computations from flat pattern generation module 334. Pattern template generation module 341 may be configured to also add seaming allowances to the pattern pieces.

When manual measurements have been used, different pattern templates formed with polylines may be used, as the number of data points recorded is greatly reduced compared to when a body scan has been performed. Fixed points for the polylines may be modified using the calculations described above, based on the measured circumferences and heights, girths, neckline and other measurements, and the arc between these fixed points may be proportionally scaled according to a standard ratio and the adjacent values.

Label creation module 342 may be configured to place identifying tags, numbers or chads on the flat patterns generated by pattern template generation module 341. By default, a text field in the template on a flat edge may be populated by the garment job number and a left or right label where necessary, such as when separate left and right leg and/or arm patterns are included.

Cutter template generation module 343 may be configured to lay out the flat patterns from multiple garments onto a larger cutter template so that efficient printing can be carried out, allowing for efficient batch printing when the correct material is loaded. Cutter template generation module 343 may ensure that the orientation of the patterns from the template are maintained, so that the fabric weft and warp are properly aligned with the lateral and longitudinal axis of the garment, respectively. If multiple garments of varying compression regimes and sizes are required, the system will autonomously nest each cut-out so that a minimum amount of material is wasted in the cutting process.

Pattern export module 343 is configured to export the nested pattern files generated by cutter template generation module 343. The files may be exported in a native vector format such as a Gerber ASCII file, or in an AutoCAD drawing exchange format (.dxf), .dwg format, adobe illustrator (.ai), encapsulated postscript (.eps), plot output (.plt), HP graphics language (.hpgl) or scalable vector graphics (.svg) file. Pattern files can also be sent to other cutting software (eg REACH) for cutting management. According to some embodiments, pattern generation application 123 may also be configured to send a work order to production, detailing the pattern tag, garment and delivery information for each pattern.

Figure 5:
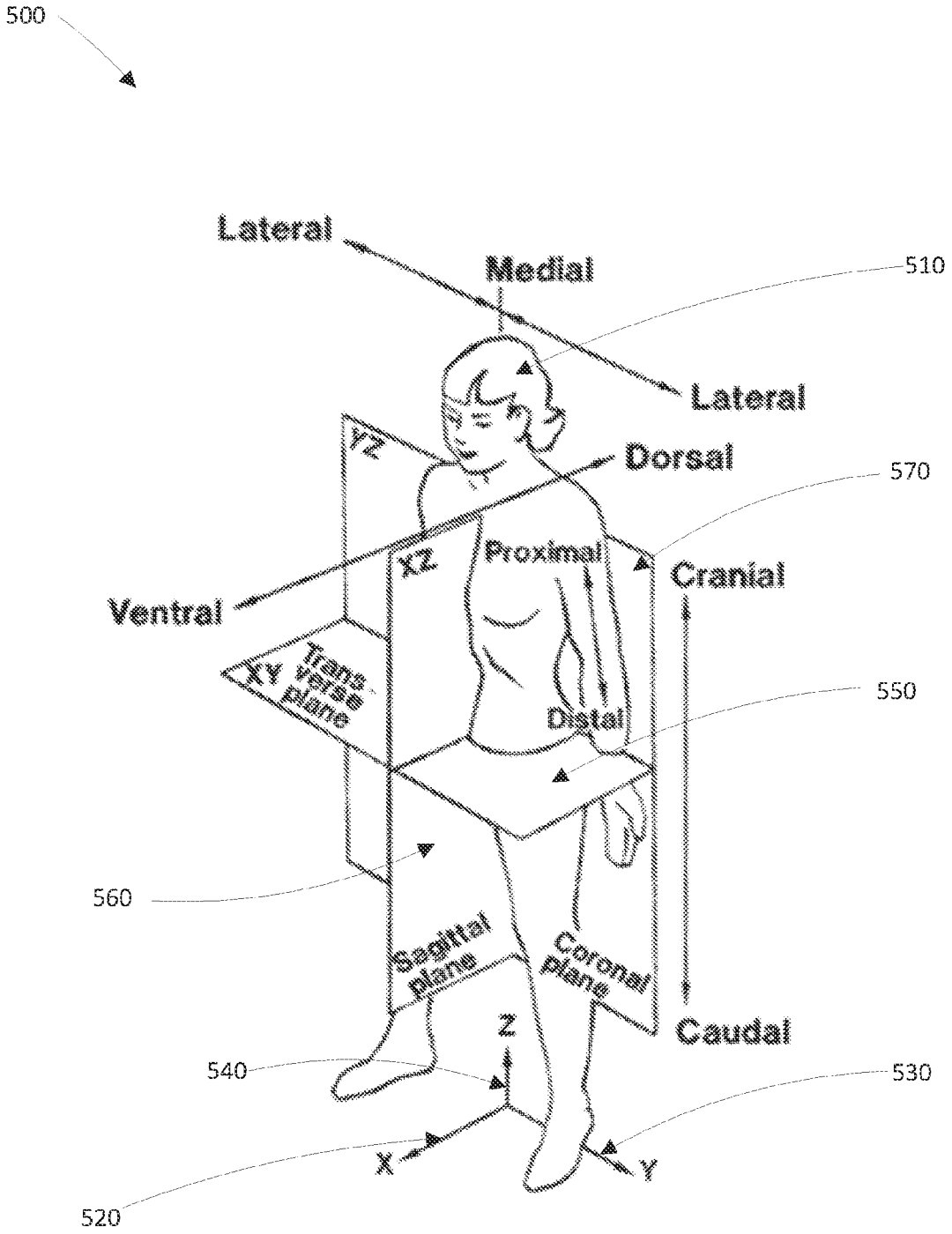
FIG. 5 is a representation of an alignment model produced by the alignment module of FIG. 3.

FIG. 5 shows an example frame generated by alignment module 322 when the scan model is aligned from a global registration coordinate system to an XYZ frame, representing the anterior (front), transverse (side) and longitudinal (vertical) major axes of the scan. The axis system is oriented in alignment with the primary axes of the rectilinear space within which the model exists, in which the Z axis 540 is allocated to the longest length of the scanned model 510, the Y axis 530 is allocated to the second largest length of the scanned model 510, and the X axis 520 is allocated to the shortest length of the scanned model 510. The origin is placed on an X-Y floor plane (not shown) at the intersection of the Z-axis 540 that passes through the apex of the head of the model 510.

If the scan only contains a leg, the XYZ coordinates are again aligned with the active rectilinear space, however in that case, Y axis 530 is allocated to the shortest length of the scanned model 510, and X axis 520 is allocated to the second largest length of the scanned model 510.

In some embodiments, physical shaped elements may be placed on the ground during scanning, enabling alignment module 322 to automatically orient the model 510. The orientation shapes may be deleted following orientation.

Figure 6:
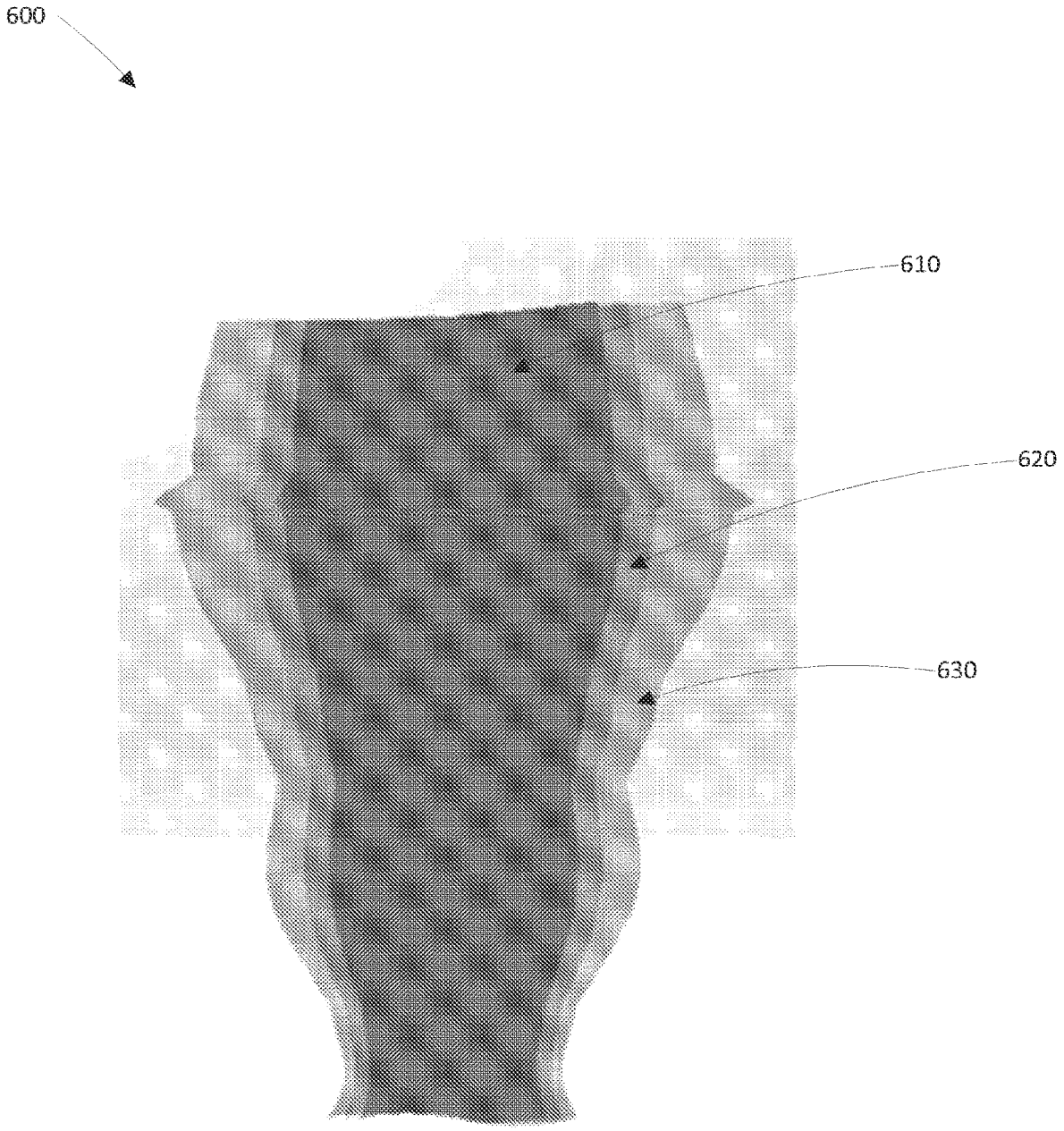
FIG. 6 is an example of three garment patterns generated by the system of Figure one based on three different compression regimes.

FIG. 6 is an example flat pattern generated for three different compression regimes for the same wearer. Pattern piece 630 is an example of a pattern piece for a garment having a low compression regime. Pattern piece 620 is an example of a pattern piece for a garment having a medium compression regime. Pattern piece 610 is an example of a pattern piece for a garment having a medium compression regime.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A method for generating at least one custom flat pattern to be cut from material for use in garment construction, the method comprising:

receiving scan data relating to a three dimensional scanned body;

receiving input regarding a garment use case;

automatically selecting an optimum compression regime according to the garment use case, the optimum compression regime including at least one compression value based at least in part on the garment use case;

calculating at least one negative ease dimension based on the at least one compression value; and modifying predetermined garment pattern dimensions based on the at least one negative ease dimension to generate the at least one custom flat pattern.

2. The method of claim 1, further comprising deriving at least one radius value for the scanned body, wherein the compression values are further based on the at least one radius value.

3. The method of claim 1, further comprising processing the scan data to remove at least one of a background element, an artefact, and noise.

4. The method of claim 1, further comprising processing the scan data to smooth the surface of the scan data and fill any holes in the scan data.

5. The method of claim 1, further comprising processing the scan data to simplify the scanned data by removing redundant data points.

6. The method of claim 1, further comprising processing the scan data to align the scan data within a single frame.

7. The method of claim 1, further comprising processing the scan data to determine a height of the scanned body.

8. The method of claim 1, further comprising deconstructing the scan data into a plurality of three-dimensional slices.

9. The method of claim 1, further comprising deconstructing the scan data into a plurality of two-dimensional planes.

10. The method of claim 1, further comprising identifying at least one landmark in the scan data.

11. The method of claim 10, wherein the at least one landmark comprises at least one of an ankle, knee, crotch, hip, waist, armpit, wrist, elbow, shoulder or neck.

12. The method of claim 10, further comprising processing the scan data to identify at least one segment of the scan data based on the identified landmark.

13. The method of claim 12, wherein the at least one segment comprises at least one of a lower leg, upper leg, torso, or arm.

14. The method of claim 1, further comprising determining the lateral dimensions of the flat pattern based on the scan data and the garment type.

15. The method of claim 1, further comprising determining the longitudinal dimensions of the flat pattern based on the scan data and the garment type.

16. The method of claim 1, further comprising exporting the at least one custom flat pattern piece to a file to allow for construction of a garment based on the at least one custom flat pattern.

17. The method of claim 1, further comprising receiving input data regarding a garment type.

18. The method of claim 1, further comprising retrieving stored data regarding material properties for a material to be used for the garment.

19. The method of claim 1, further comprising generating at least one flat pattern identification tag associated with the at least one custom flat pattern.

20. A flat pattern generation device for generating at least one custom flat pattern to be cut from material for use in garment construction, the device comprising:

at least one processor; and memory accessible to the processor, the memory storing program code which, when executed by the processor, causes the processor to perform a method, the method comprising:

receiving scan data relating to a three dimensional scanned body;

receiving input regarding a garment use case;

automatically selecting an optimum compression regime according to the garment use case, the optimum compression regime including at least one compression value based at least in part on the garment use case;

calculating at least one negative ease dimension based on the at least one compression value; and modifying predetermined garment pattern dimensions based on the at least one negative ease dimension to generate the at least one custom flat pattern.

* * * * *